United States Patent [19]

Raffenberg

[11] Patent Number: 4,550,897

[45] Date of Patent: Nov. 5, 1985

[54] TRACK CLEARING DEVICE FOR PUSHING APART RAIL VEHICLES

[76] Inventor: Bruno Raffenberg, Ahornweg 10, Dortmund 1, Fed. Rep. of Germany, 4600

[21] Appl. No.: 581,971

[22] Filed: Feb. 21, 1984

[30] Foreign Application Priority Data

Mar. 30, 1983 [DE] Fed. Rep. of Germany ... 8309463[U]

[51] Int. Cl.[4] ..... B66F 3/00

[52] U.S. Cl. ..... 254/93 R; 254/124

[58] Field of Search ..... 254/84, 85, 93 R, 124; 104/273; 72/705; 29/252

[56] References Cited

U.S. PATENT DOCUMENTS 3,362,351 1/1968 Robertson ..... 254/84

3,819,153 6/1974 Hurst et al. ..... 254/124

*Primary Examiner*—Robert C. Watson

*Attorney, Agent, or Firm*—Eric P. Schellin

[57] ABSTRACT

A track clearing device is described using hydraulic power for pushing apart rail vehicles which have been pushed into or onto each other. To provide such a track clearing device which may also be used successfully even where the anchorage resistance of the rails is very small and which enables derailed cars to be re-railed, an expander is provided comprising two pivotable expander arms, a pivot pin, two transverse guide pieces mounted so as to be displaceable by sliding and each having linked to it by articulated joints two lifter supports, two lifters and two displacement cylinders.

5 Claims, 4 Drawing Figures

TRACK CLEARING DEVICE FOR PUSHING APART RAIL VEHICLES

BACKGROUND OF THE INVENTION

1. Field of the Invention

The invention relates to a clearing device using hydraulic power for pushing apart rail vehicles which have been pushed into or onto each other.

2. Description of Prior Art

A device is known under DE-GM 18 57 540 for clearing wreckage after railway accidents by pulling apart rail vehicles which have been pushed into or onto each other.

This known device produces tractive motion by means of a hydraulic trunk piston press with a means of traction passing through the hollow piston. The housing of the trunk piston press is secured in place by means of a rope winch which is attachable to the rails of the permanent way.

Such a device, however, cannot be used successfully if the anchorage resistance of the rails is significantly less than the tractive force required to pull the railcars apart.

SUMMARY

The basis of the invention is to create a clearing device for pushing apart railcars which have been pushed into or onto each other, which can be used successfully even where the anchorage resistance of the rails is very small and which in addition enables derailed railcars to be re-railed.

The invention consists in solving this problem by an expander comprising two pivotable expander arms, a pivot pin, two displaceable transverse guide pieces each linked by articulated joints to two lifter supports, two lifters and two displacement cylinders.

Each expander arm is fitted to advantage with at least one couplable re-railing bridge, a pivot arm and a grab claw.

The lifters are preferably of the telescopic type.

A further characteristic of the innovation is the possibility of having the expander supported by three height-adjustable support elements.

For the purpose in view each support element is fitted with a support roller pivotable about a vertical axle.

At least one support roller is fitted with a drawbar.

The particular advantage of the innovation, apart from its simplicity and universality of application, lies specifically in the fact that the expander can be used for rescuing people trapped in railcars.

BRIEF DESCRIPTION OF THE DRAWINGS

The innovation is described in more detail with the aid of a drawing showing schematically an example of its construction.

DETAILED DESCRIPTION

Figure 1:
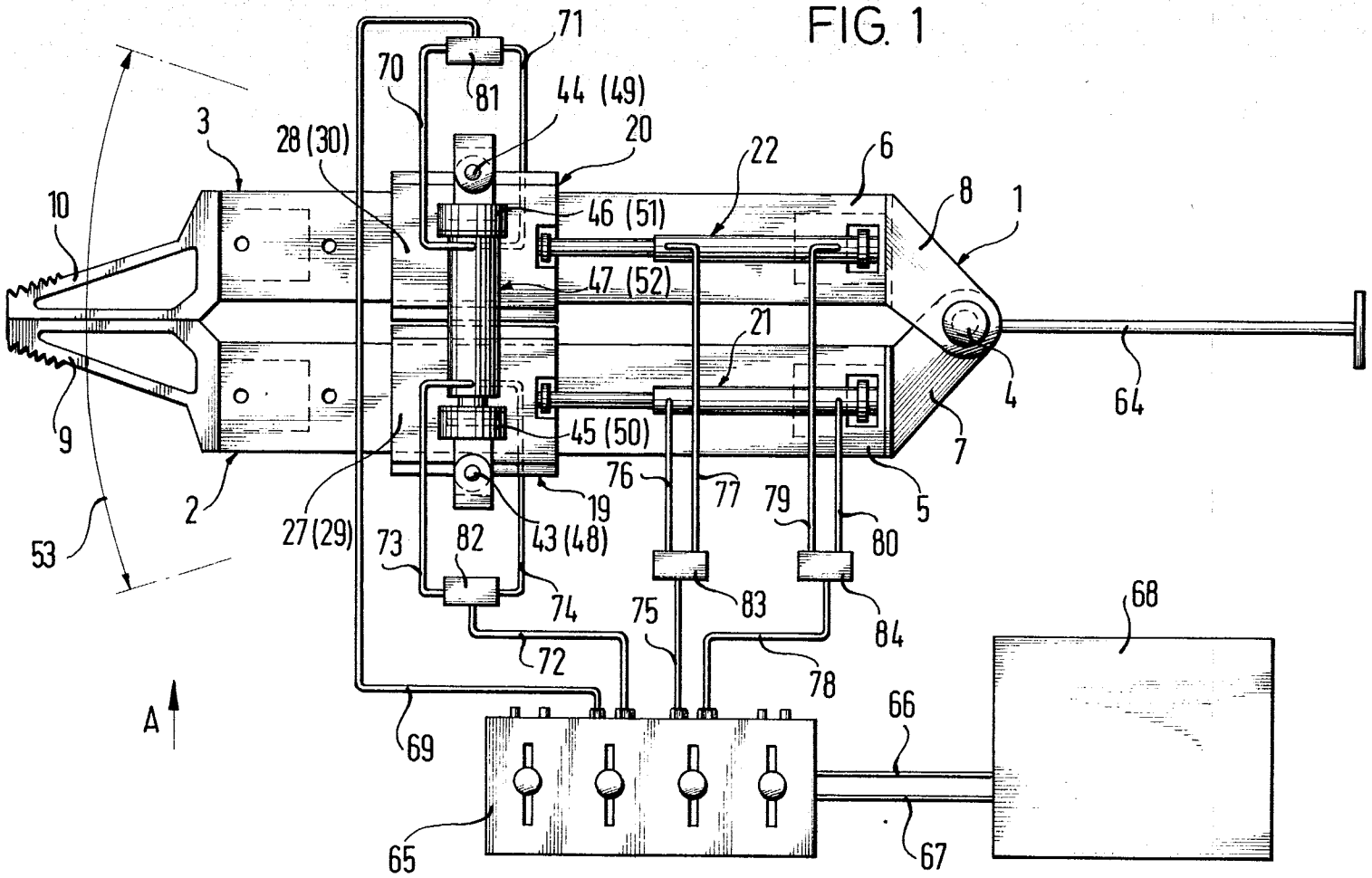
FIG. 1 shows a clearing device for pushing apart railcars which have been pushed into or onto each other, comprising an expander, a pump assembly, a control panel, four distributor valves and fourteen connecting hoses in basic outline.
Figure 2:
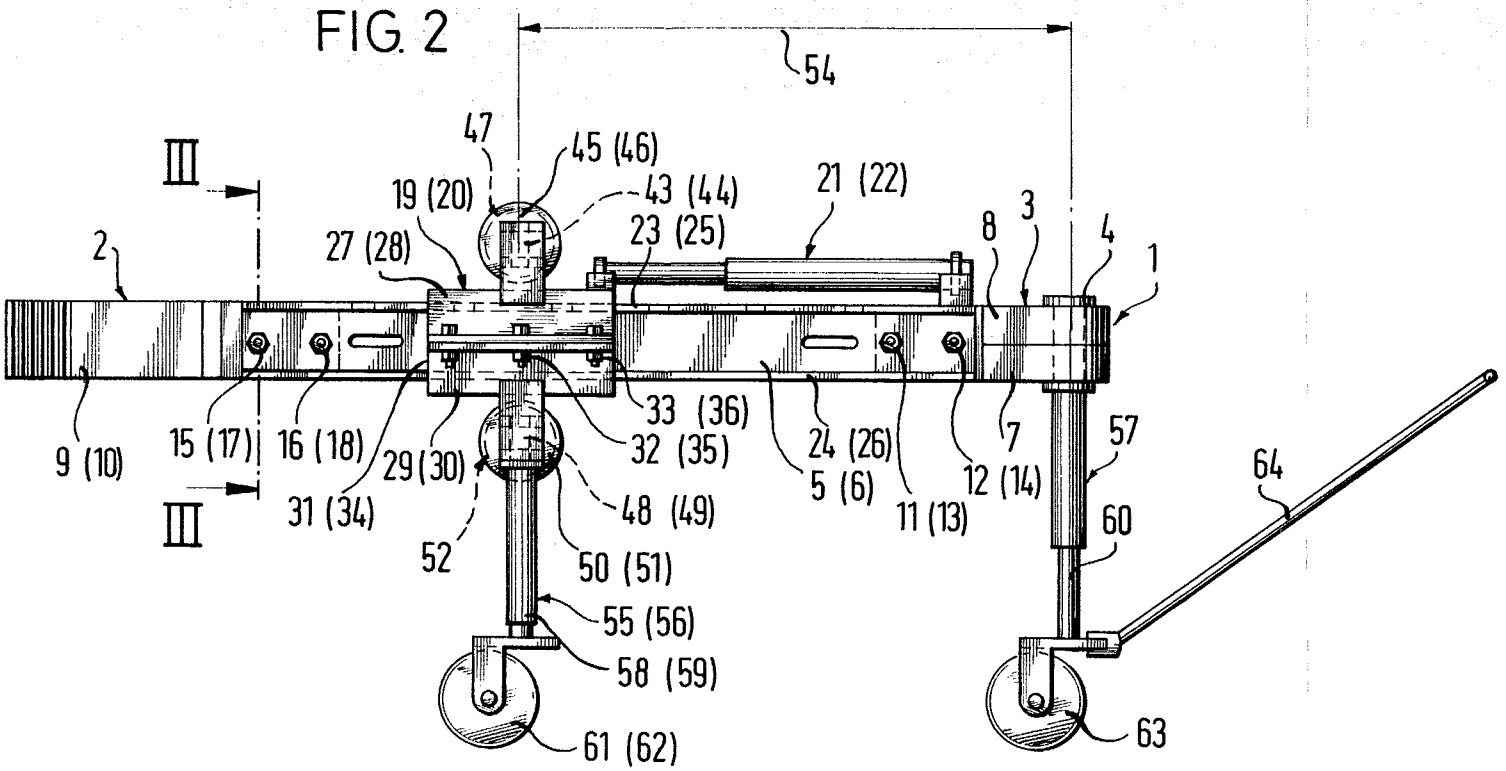
FIG. 2 shows a view of the expander in the direction of the arrow A in FIG. 1.
Figure 3:
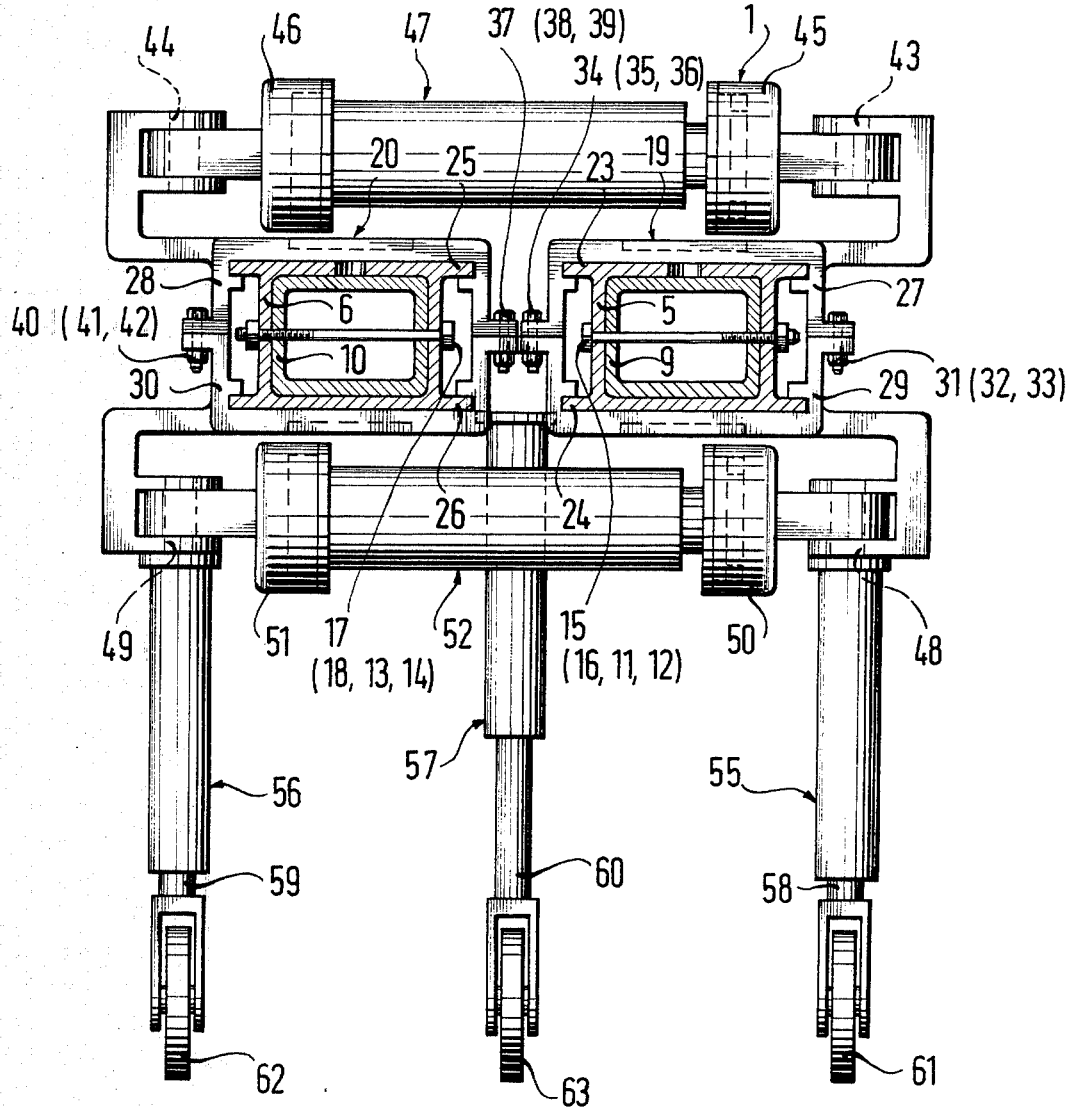
FIG. 3 shows a section along the line III—III in FIG. 2 on an enlarged scale.

An expander 1 has two pivotable expander arms 2,3, which are connected together by a pivot pin 4.

Each expander arm 2,3 has a coupable re-railing bridge 5,6 a pivot arm 7,8 and a grab claw 9,10.

A total of 8 bolts 11 to 18 are provided for securing the pivot arms 7,8 and the grab claws 9,10.

A transverse guide piece 19,20 is fitted to each re-railing bridge 5,6. Both transverse guide pieces 19,20 are coupled to respective displacement cylinders 21,22.

All guide surfaces of the transverse guide pieces 19, 20 which come into contact with the flanges 23 to 26 of the re-railing bridges 5, 6, are coated with plastic material so that a low coefficient of friction is achieved.

Each transverse guide piece 19,20 is made up of an upper guide section 27,28 a lower guide section 29,30 and six bolts 31 to 36, 37 to 42.

Each upper guide section 27,28 is connected via a joint 43,44 and a lifter support 45,46 to a lifter 47. Similarly each lower guide section 29,30 is connected via a joint 48,49 and a lifter support 50,51 to a lifter 52.

The expanding motion of the expander arms 2,3 for pushing apart the railcars is produced by the lifters 47,52 and the displacement cylinders 21,22.

The arc of expansion 53 described by the expander arms 2,3 is dependent on the travel of the lifter 47,52 and the distance 54 of the tranverse guide pieces 19,20 from the pivot pin 4.

Three vertically adjustable support elements 55, 56,57 are provided to support the expander 1. The first of these support elements 55 is attached to the lower guide section 29, the second 56 to the lower guide section 30 and the third 57 to the pivot arm 7.

Each support element 55, 56, 57 has a support roller 61,62,63 pivotable about a vertical axle 58,59,60. A drawbar 64 is attached to support roller 63.

The lifters 47,52 and the displacement cylinders 21, 22 are operated from a control panel 65, which is connected via two connecting hoses 66,67 to a pump assembly 68.

The control panel 65 is connected via twelve connecting hoses 69 to 80 and four distributor valves 81 to 84 to the lifters 47,52 and the displacement cylinders 21,22.

Figure 4:
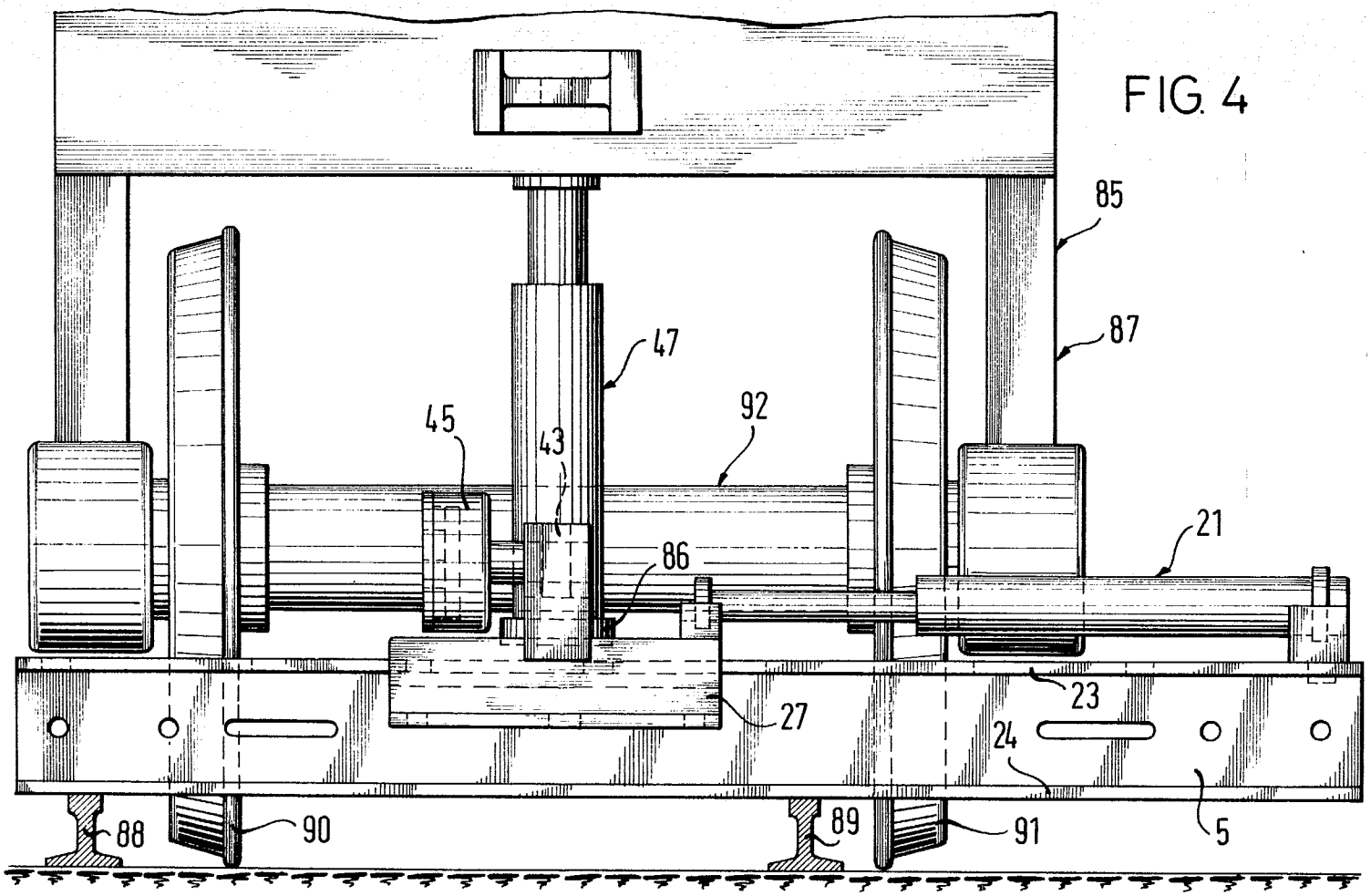
FIG. 4 shows a partial view of a derailed railcar with a section through the bogie and with the parts of the expander which are used for re-railing shown in position.

When a derailed railcar 85 is being re-railed (FIG. 4) only a few parts of the expander 1 are used. For this operation only for example the re-railing bridge 5, the upper guide section 27, the lifter 47 and the displacement cylinder 21 come into action.

The lifter 47, which stands with its foot 86 on the upper guide section 27, first lifts one half railcar 87 above the level of the two rails 88,89. Then raised railcar half 87 is shifted to the left by the displacement cylinder 21 until the two wheels 90,91 of the wheel set 92 are over the rails 88,89. The lifter then lowers the railcar half 87 until the wheels 90,91 of the wheel set 92 come to rest on the rails 88,89.

I claim:

1. An apparatus for pushing apart railway vehicles, comprising:

an expander means having two expander arms, each expander arm comprising a re-railing bridge, a pivot arm coupled to one end of the re-railing bridge, and a grab claw mounted to the other end of the re-railing bridge, wherein the expander arms are pivotally coupled to one another by a pivot pin;

two guide means having upper and lower guide members, each guide means is slidably mounted on a different expander arm;

two lifting means are transversely mounted across the expander arms by the guide means for opening and closing the pivotable expander arms of the expander means;

two displacement cylinders, each displacement cylinder having one end that is mounted to one of the guide means and another end that is mounted to one of the expander arm, wherein the displacement cylinders are used to longitudinally position the guide means and therefore the lifting means along the expander means; and a source of fluid under pressure having a pump that is fluidically coupled to the lifting means and the displacement cylinders through a control panel and hoses for controlling the operating of the lifting means and the displacement cylinders.

2. The apparatus as defined by claim 1 wherein each of the lifting means comprises a telescoping hydraulic cylinder.

3. The apparatus as defined by claim 2 wherein each of the guide means is provided with vertically adjustable support means.

4. The apparatus as defined by claim 3 wherein each of the vertically adjustable support means is provided with a support roller that is pivotable about a vertical axis.

5. The apparatus as defined by claim 4 further comprising a draw bar that is coupled to at least one of the vertically adjustable support means.

* * * * *